US006103960A

United States Patent [19]

Huang

[11] Patent Number: 6,103,960

[45] Date of Patent: Aug. 15, 2000

[54] MUSICAL MOVEMENT

[75] Inventor: Long Hsi Huang, Taichung, Taiwan

[73] Assignee: Sankyo Seiki Mfg. Co., Ltd., Nagano, Japan

[21] Appl. No.: 09/430,638

[22] Filed: Oct. 29, 1999

[30] Foreign Application Priority Data

Nov. 2, 1998 [CN] China ..... 87218201
Sep. 2, 1999 [JP] Japan ..... 11-248181

[51] Int. Cl.[7] ..... G10F 1/06

[52] U.S. Cl. ..... 84/95.1; 84/95.2

[58] Field of Search ..... 84/95.1, 95.2, 84/94.1, 94.2, 96

[56] References Cited

U.S. PATENT DOCUMENTS

| | | | |
|---|---|---|---|
| 4,570,524 | 2/1986 | Isaka et al. . | |
| 4,727,358 | 2/1988 | Burt, III | 84/384 R |
| 4,890,528 | 1/1990 | Kamijima | 84/95.2 |
| 5,161,420 | 11/1992 | Feng | 74/53 |
| 5,371,318 | 12/1994 | Hsu et al. | 84/95.2 |
| 5,430,239 | 7/1995 | Chen | 84/95.2 |
| 5,449,856 | 9/1995 | Nakamori | 84/95.1 |
| 5,459,278 | 10/1995 | Hsu | 84/95.1 |
| 5,473,969 | 12/1995 | Chen | 84/95.2 |
| 5,523,523 | 6/1996 | Chen | 84/95.2 |
| 5,543,577 | 8/1996 | Zhu et al. | 84/95.2 |
| 5,561,253 | 10/1996 | Chen | 84/95.2 |
| 5,703,305 | 12/1997 | Isaka | 84/95.1 |

*Primary Examiner*—Bentsu Ro
*Assistant Examiner*—Kim Lockett
*Attorney, Agent, or Firm*—NcAulay Nissen Goldberg & Kiel, LLP

[57] ABSTRACT

A musical movement in which a drum has a series of pins that engage the reeds of a vibration plate to play a tune has an improved design which, among other things, provides three separate rotational outputs to engage and move objects such as toy figurines and the like. Two of these outputs are the opposite ends of a primary shaft. The third output is at the end of a secondary shaft which has an axis that is perpendicular to the axis of the primary shaft. To provide movement with minimum vibration and optimum dimensional stability, a first end plate of the drum is composed of a double gear having an interior set of teeth that are part of a ratchet mechanism for driving the double gear from a hand crank. The outer teeth of this double gear are a first bevel gear that engages a second bevel gear that in turn causes the secondary shaft to rotate. Two support tubes extend from either end of this double gear to surround and support the primary shaft. One end of the drum is firmly fixed to this end plate. The other end of the drum is firmly fixed to a second end plate. The second end plate has interior grooves which engage corresponding grooves on the primary drive shaft causing the primary drive shaft to rotate when the double gear end plate drives the drum which in turn drives the second end plate. This shaft extends through central openings on both of the end plates and extends out of the frame to form two drive shaft ends. The support tubes that extend out of each end of the double gear end plate are equal to each other and support a substantial portion of the primary drive shaft.

17 Claims, 9 Drawing Sheets

MUSICAL MOVEMENT

FIELD OF INVENTION

The present invention relates to a musical movement, especially one manually driven, in which output force can be directed in various directions and which can be readily assembled.

BACKGROUND OF THE INVENTION

Conventionally, various manually-driven musical movements are proposed. These manually-driven musical movements comprise a worm gear and play music by rotating a drum with force transmitted from the worm gear to the drum when manually rotating a crank which is rotatably held on a frame. In other words, when the crank is manually rotated, a gear engaged with the worm gear rotates such that an elastic convex piece, projecting in the outer circumferential direction, simultaneously moves. Then, a ratchet, as an end plate of the drum, moves by being pushed by the elastic convex piece of the gear; as a result, the end plate and the drum rotate together. When the drum rotates, pins on the drum pluck reeds such that the reeds play music.

Also, the reeds are formed to play a given note by rotating in a given direction; therefore, it is necessary to establish the drum, which plucks the reeds, to rotate in one direction. As is in the above manually-driven musical movements, when the crank, or the worm gear, rotates in the reverse direction, the rotational force is prevented from being transmitted to the ratchet by warping the elastic convex piece of the gear. In other words, the elastic convex piece of the gear and the ratchet are a mechanism to rotate the drum in only one direction. In this mechanism, when the crank is rotated in the reverse direction, the rotational force is not transmitted to the drum, and the drum does not rotate in the reverse direction.

In order to play music with the above manually-driven musical movements, an action of engaging the pins on the drum with the reeds occurs while the drum is rotated, and an action of disengagement there between are repeated. A significantly large force is required to rotate the drum while the pins and the reeds are engaged with each other. As a result, a large force is applied to the engaging portion between the elastic convex piece of the gear and the ratchet such that a bend and a warp can be easily caused in the elastic convex piece as a member of the ratchet mechanism.

Also, due to the weak part in the force-transmission area, the rotation of the drum and the gear cannot be used as a significant source of output force for, for example, moving ornaments in a shape of animals and the like. Hence, the above manually-driven musical movements can be hardly used as a drive for a large ornament or a plurality of ornaments. Consequently, these musical movements are not desirable in appearance or in variety.

A purpose of the present invention is to provide a multi-functional musical movement which, as well as playing music, can be used as a drive wherein a plurality of actions to add visual stimuli to ornaments can be performed in a stable manner.

A further purpose is to provide a musical movement comprising a transmission mechanism, more specifically, a ratchet mechanism, which is not damaged with a large load during driving.

Another purpose is to provide a musical movement which enables swift and precise assembly of a drum and an end plate.

DESCRIPTION OF THE PREFERRED EMBODIMENTS

FIGS. 1 through 5 describes a first embodiment of the present invention.

Figure 1:
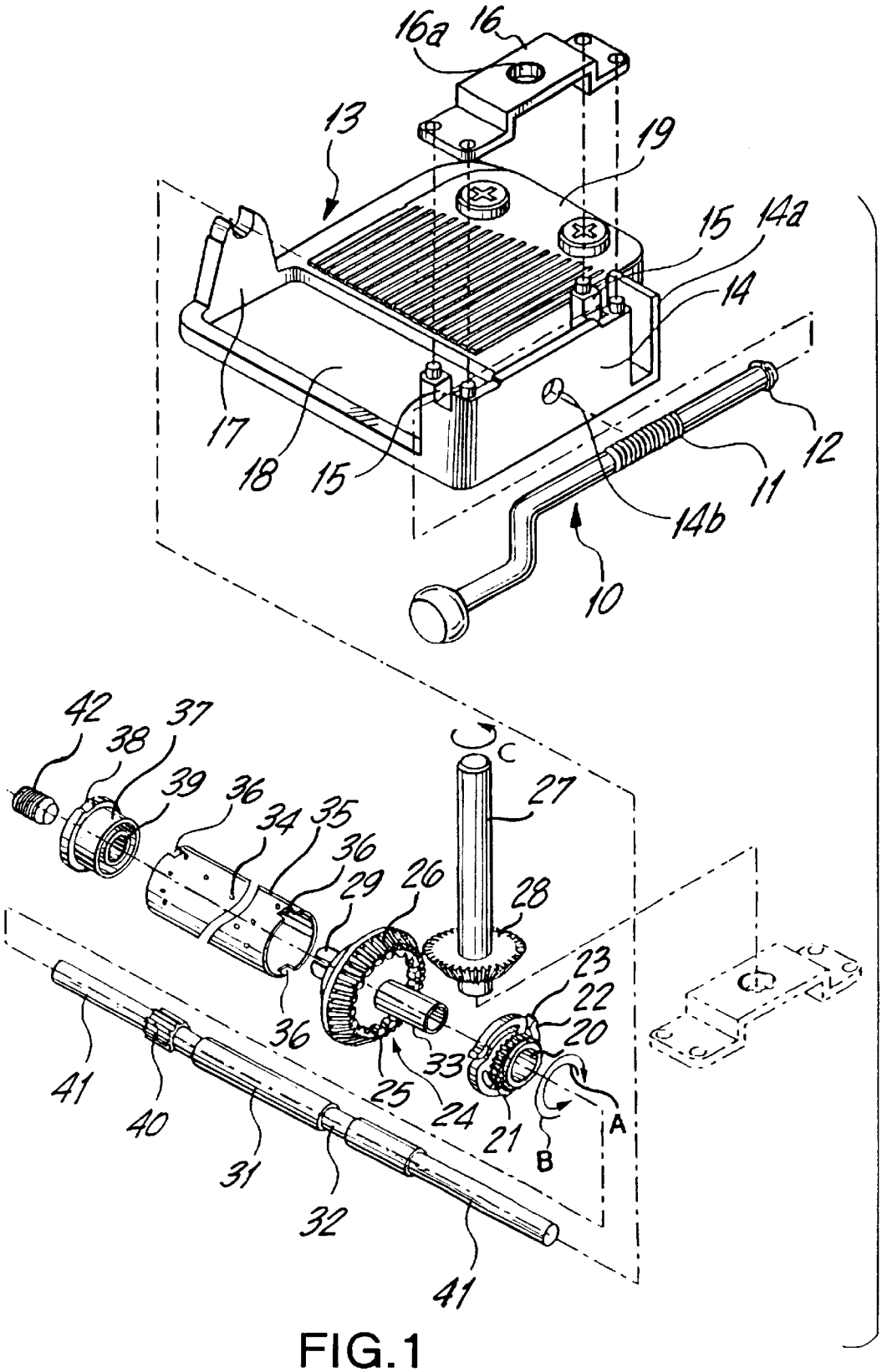
FIG. 1 is a perspective exploded view of a musical movement of Embodiment 1 according to the present invention.

As shown in FIG. 1, the embodiment comprises metal frame 13; vibration plate 19 which is fixed to frame 13; drum 35 and crank 10, all of which are rotatably held on frame 13. The musical movement of this embodiment is manually driven in which music is played by manually rotating crank 10. However, the method of driving is not limited to the manual method; instead of crank 10 for manual driving, it can be a motor-driven musical movement having a drive shaft which is rotated by a motor.

Crank 10 is rotatably placed on frame 13 to be perpendicular to drum 35 and is a driving shaft that provides the power to rotate drum 35. Also, a ratchet mechanism is placed between crank 10 and drum 35. The ratchet mechanism transmits rotation of crank 10 in only one direction to drum 35 thus limiting the direction of rotation of drum 35 to one direction. When crank 10 is rotated in the reverse direction, the rotational force of crank 10 is not transmitted to drum 35 due to the ratchet mechanism discussed later.

Worm gear 11 is formed in the middle of crank 10 to transfer the rotation of crank 10 to drum 35 while tappet piece 12 is formed in a groove at the end of crank 10 to prevent sliding of crank 10. Crank 10 is rotatably supported by locating rack 14 which is integrally formed at frame 13 as a support. Also, locating rack 14 is formed of walls, including side walls and a connection piece, in a shape of a square with one side open on the base portion of frame 13. U grooves 15 are formed at both sides of locating rack 14 to mount crank 10 thereat. Also, cover plate 16 is attached at the top of locating rack 14 covering U grooves 15 by which worm gear 11 and part of the ratchet mechanism are protected. U grooves 15 of frame 13, together with cover plate 16, rotatably support crank 10.

Tappet piece 12 at the end of crank 10 is made of a C-shaped metal member. The end of crank 10 having tappet piece 12 can be pushed against end wall 14*a* formed at the outside of the locating rack 14 to prevent outward shifting of crank 10. Therefore, crank 10 is only movable in the axial direction in a range in which tappet piece 12 can shift between end wall 14*a* and U groove 15 on the end wall 14*a* side (an extremely small distance).

Worm gear 11 of crank 10 is engaged with gear portion 21 formed on pin wheel 20 as a part of the ratchet mechanism. The pin wheel 20 includes radial arms 22 which extend in the circumferential direction and which are resilient and can deflect in the radial direction. Hooks 23 have the shape of a trapezoid projecting from the edges of arms 22 in the circumferential direction; hooks 23 are to reinforce arms 22. Pin wheel 20 as described above is inside double gear 24 to form part of the end plate in one end of drum 35.

Double gear 24 is engraved on the side opposite from the side facing drum 35 with an inner tooth gear in which inner teeth 25 are formed in the inner circumference of this engraved area while hollow shaft 33 extends from the center in the axial direction. Also, pin wheel 20 is held in the engraved area of double gear 24. In other words, pin wheel 20 is inside double gear 24 while hooks 23 are engaged with inner teeth 25 by inserting hollow shaft 33 of double gear 24 into a hole formed at the center of gear portion 21 of pin wheel 20. Moreover, pin wheel 20 is rotatably supported by hollow shaft 33.

Figure 5:
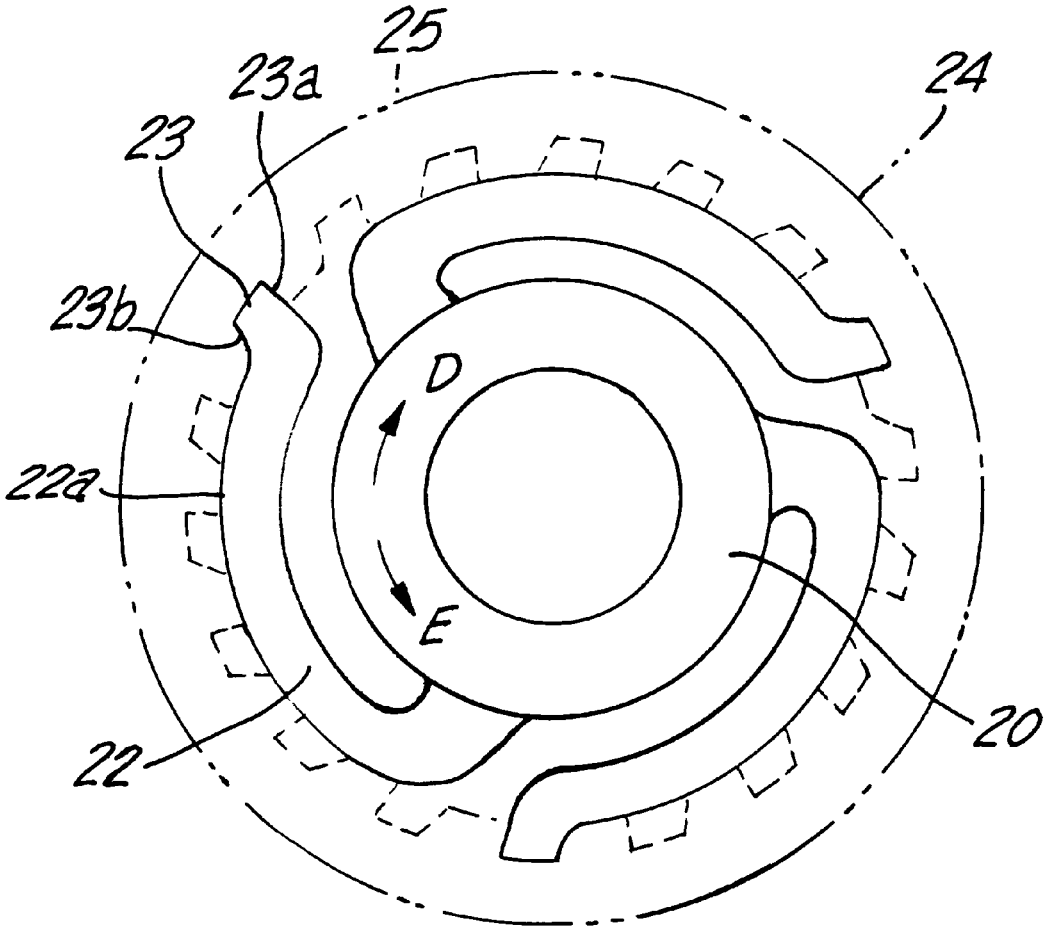
FIG. 5 is a view showing the relation between a pin wheel and the double gear forming a ratchet mechanism of the musical movement of Embodiment 1 viewed from the direction indicated with Arrow IV in FIG. 3.
Figure 6:
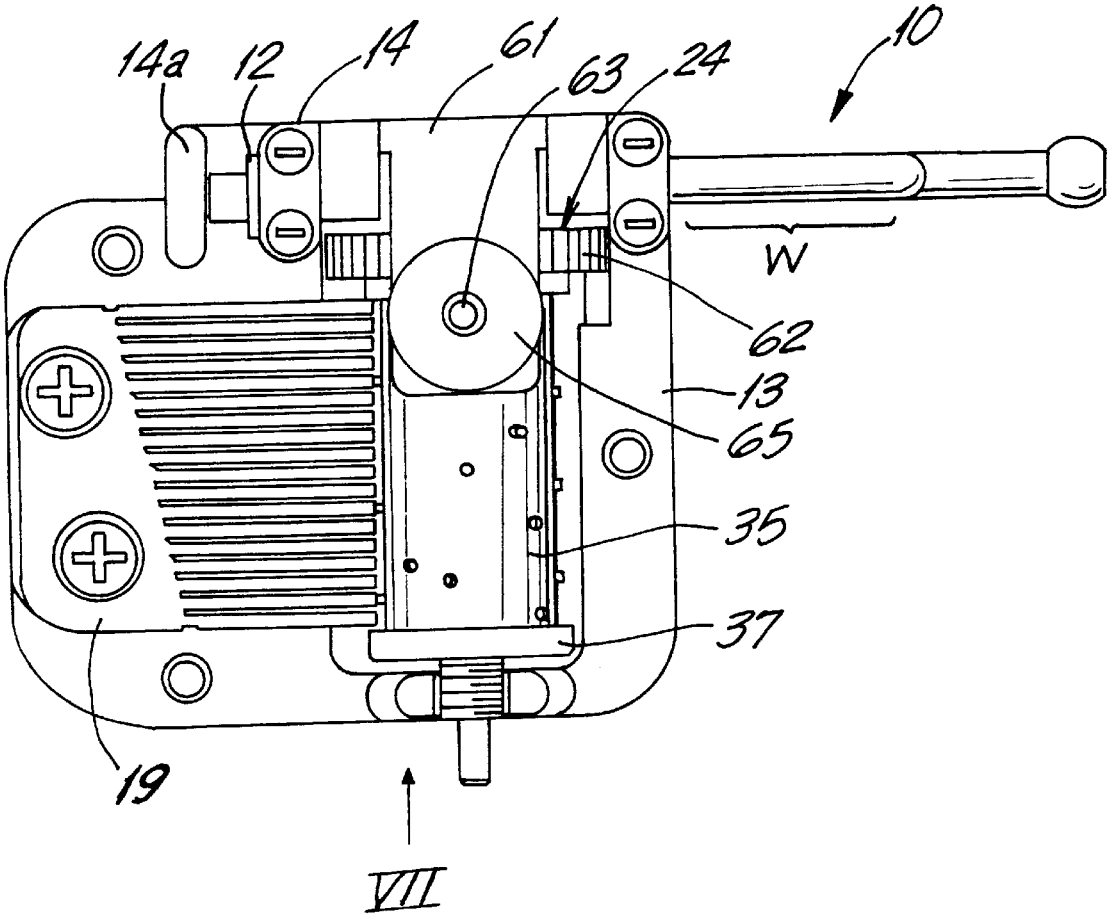
FIG. 6 is a plan view of a musical movement of Embodiment 2 according to the present invention.
Figure 7:
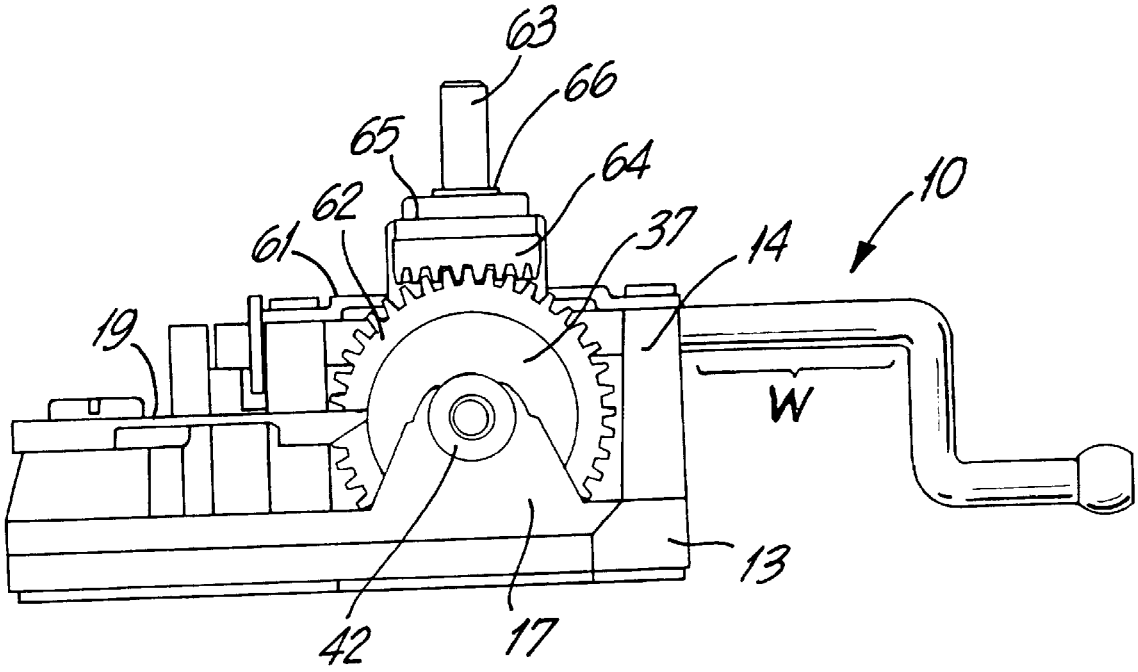
FIG. 7 is a front view of the musical movement shown in FIG. 6, viewed from the direction indicated with Arrow VII in FIG. 6.

Also, the relationship between arms 22 and hooks 23 at their edges of pin wheel 20, which is a part of the ratchet mechanism, and inner teeth 25 of double gear 24 is shown in FIG. 5.

In other words, hooks 23 formed at the edge of each of the three arms 22 are separately fitted between teeth of inner teeth 25 to engage with inner teeth 25. Side 23*a,* which faces the normal rotational direction (direction indicated with Arrow D in FIG. 5), is formed almost vertical while other side 23*b,* which faces the reverse rotational direction (direction indicated with Arrow E in FIG. 5), is formed slanted; as a result, hooks 23 are formed in a shape of an approximate trapezoid. The rest of inner teeth 25, where hooks 23 are not fitted, are adjacent to the outer circumference 22*a* of arms 22.

Accordingly, when pin wheel 20 rotates in the direction indicated by Arrow D, hooks 23 engage with teeth of inner teeth 25 such that pin wheel 20 and double gear 24 rotate together. On the other hand, when pin wheel 20 rotates in the direction indicated with Arrow E, hooks 23 are disengaged from inner teeth 25, and circumferential arms 22 deflect radially inward such that pin wheel 20 and double gear 24 disengage.

According to the above mechanism, when pin wheel 20 rotates in the direction indicated with Arrow A (see FIG. 1) by drive of crank 10, drum 35, having double gear 24 as its end plate, rotates. In this case, arms 22, except for hooks 23, warp toward inner teeth 25, and outer circumference 22*a* of arms 22 contact the edges of inner teeth 25 to provide support for the arms 22. Consequently, inner teeth 25 receive the pressure of arms 22 when the pin wheel drive the double gear 24.

On the other hand, when pin wheel 20 rotates in the reverse direction (indicated with Arrow B) by reverse rotational drive of crank 10, arms 22 deflect inward, and hooks 23 pass over inner teeth 25. Hence, the rotation of pin wheel 20 is prevented from being transmitted to double gear 24 Accordingly, the ratchet mechanism is formed of pin wheel 20 and double gear 24. Transmission of rotation can be turned on or off by engagement or disengagement between hooks 23 formed at the edges of arms 22 of pin wheel 20 and inner teeth 25 of double gear 24.

As described above, arms 22 generally are such that the outer circumference 22*a* is adjacent to the edges of inner teeth 25 while only projected hooks 23 are engaged with inner teeth 25. Therefore, arms 22 do not warp outward such that it can sufficiently bear strong force during transmission of rotation. Also, the process of preventing transmission of rotation is smoothly carried out by deflecting the arms only inward. Accordingly, the size of double ear 24 and pin wheel 20, press-fitted in double gear 24, can be decreased while hose small size parts can efficiently perform transmission of rotation. In this embodiment, arms 22 are placed adjacent to the edges of inner teeth 25 which are not engaged with hooks 23, and arms 22 are pushed outward during rotation to contact the edges of inner teeth 25. However, the arms 22 can be designed to already contact the teeth.

On the other hand, the center of the side of double gear facing drum 35 has hollow shaft 29 comprising an engaging piece as a reverse nuckle or pawl 29*a* which is evenly cut. Hollow shaft 29 is coaxial with hollow shaft 33 and shares continual space with hollow shaft 33. Transmission shaft 31 extends through double gear 24 and through both hollow shafts 29 and 33. Transmission shaft 31 includes an annular grove 32 which is engaged by the pawl 29*a* at the edge of hollow shaft 29. As a result, transmission shaft 31 is held against axial movement in relation to double gear 24. In other words, the edge 29*a* of hollow shaft 29 is an engaging piece which fits in groove 32.

Figure 2:
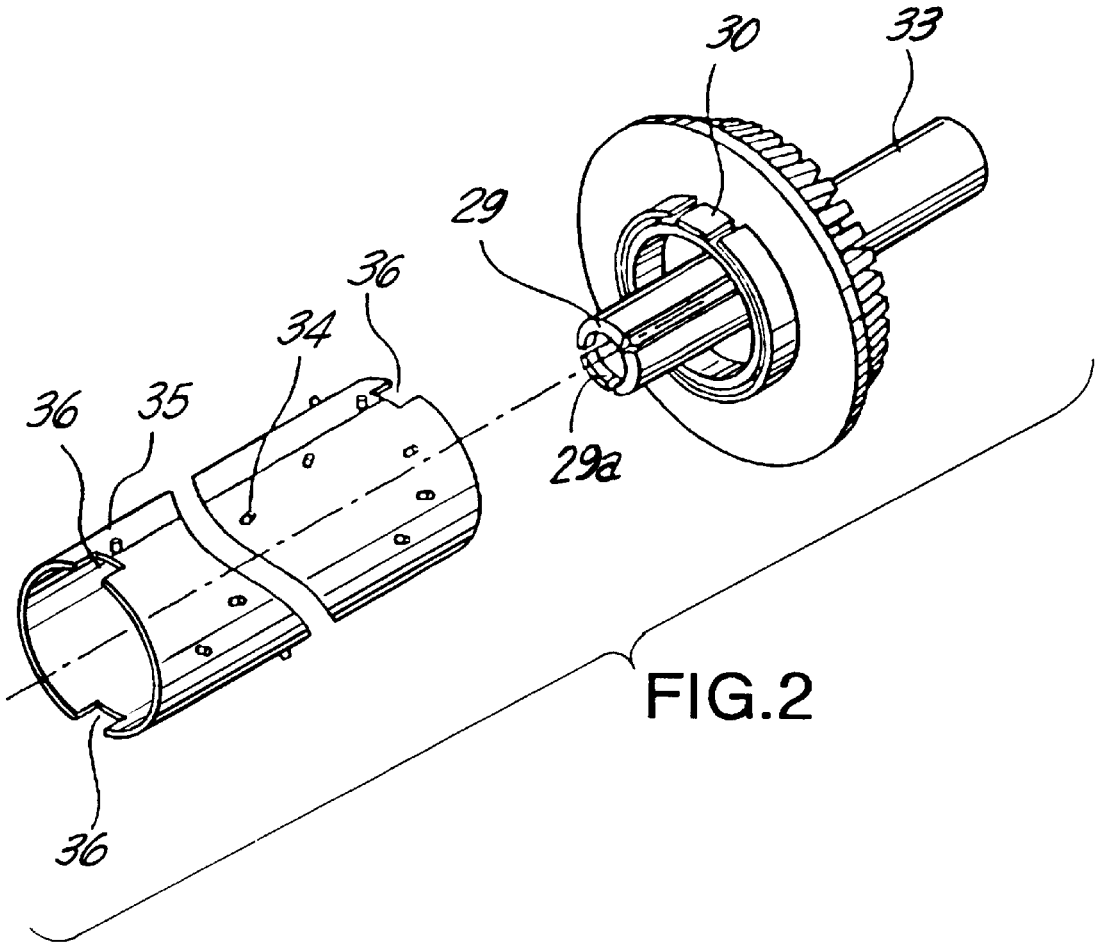
FIG. 2 is a perspective view showing a portion of engagement between a double gear and a drum of the musical movement shown in FIG. 1.
Figure 3:
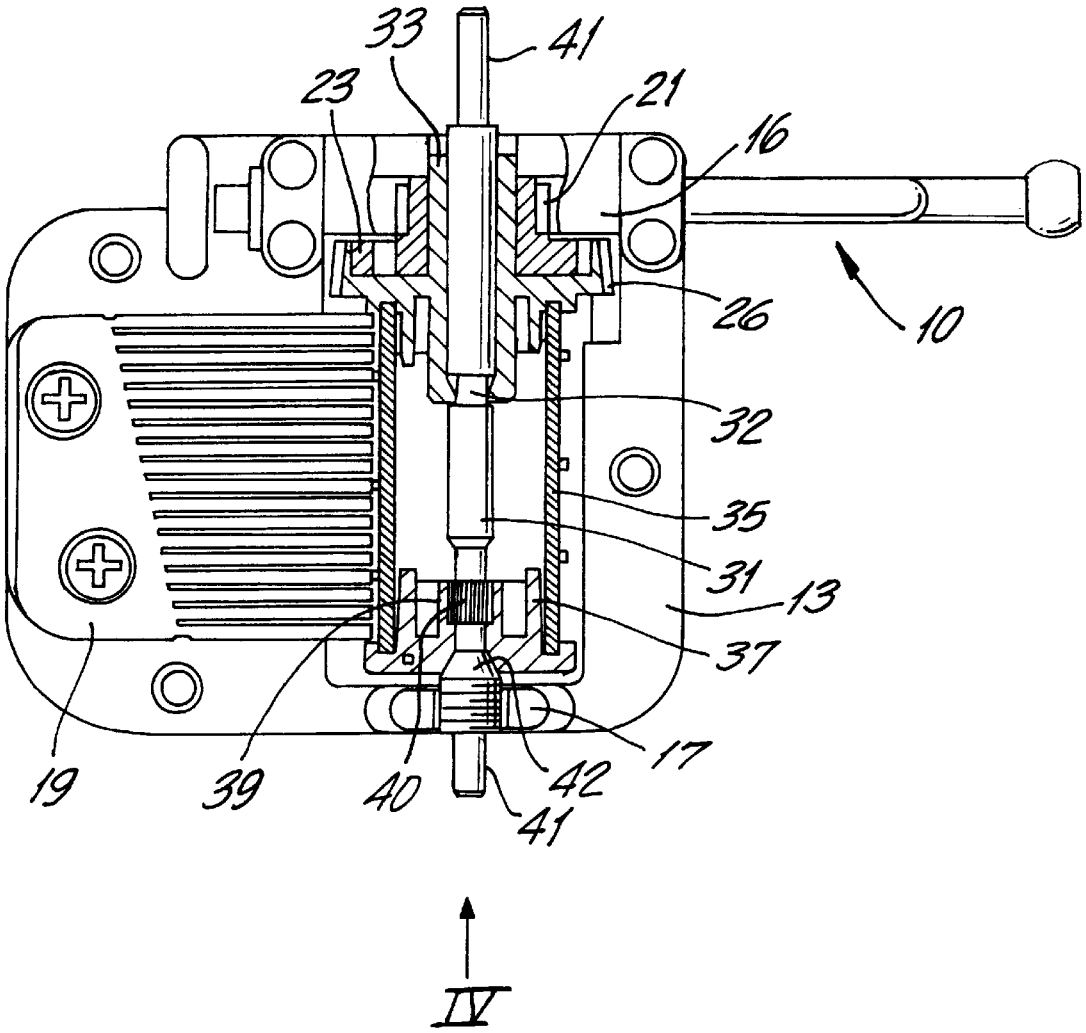
FIG. 3 is a partial cross section of a plan view showing the assembled musical movement of FIG. 1.
Figure 4:
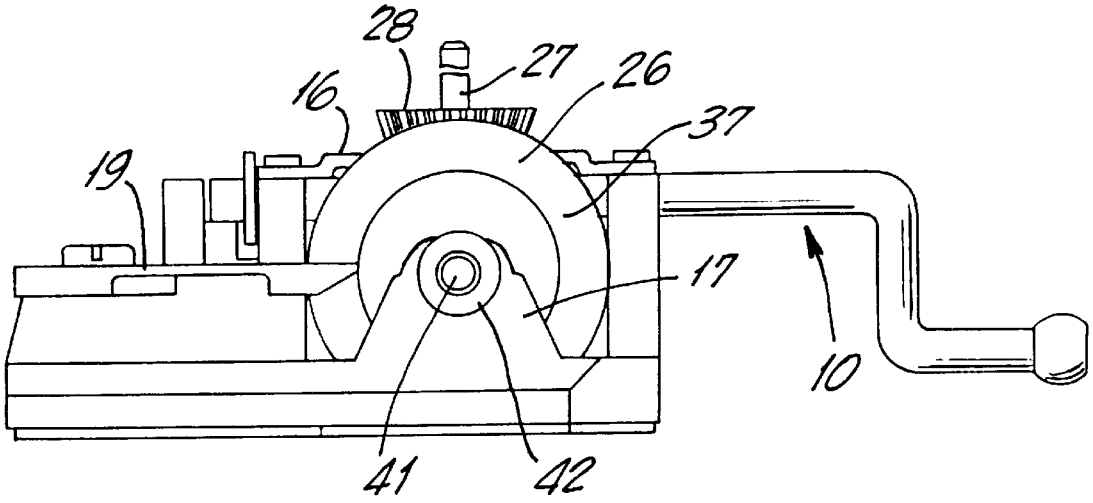
FIG. 4 is a front view of the musical movement shown in FIG. 3, viewed from the direction indicated with Arrow IV in FIG. 3.

Also, the side of double gear 24 facing drum 35, as shown in FIG. 2, has tenon 30 as a projection. Positions of double gear 24 and drum 35 are fixed in the circumferential direction by engaging tenon 30 to notch 36 formed at one end of drum 35. Accordingly, the double gear functions as an end plate of drum 35. In the above mechanism, drum 35 and double gear 24 are fixed to each other with a detent, and their assembly is simple. Two tenons or projections 30 are formed at the positions apart from each other by 180 degrees while two notches 36 are formed corresponding to the tenons.

In one embodiment, the two support tubes 29 and 33 are substantially equal in length to provide balanced support for the shaft 31. In that embodiment, the tubes 29, 33 extend over a distance that encompasses approximately 30 percent of the length of the shaft 31. This provides sufficient support for the shaft 31 to minimize racking and other vibration and to assure a smooth stable rotational output power at the two ends of the output shaft 31. It is believed that as long as the dual support 29, 33 and double gear 26 between them cover at least 25 percent of the shaft length, appreciable rotational stability will be achieved.

The length of the through hole is about 78% of the length of drum 35 in this embodiment. It is preferable to establish it between 50 and 100%. Especially, it is advantageous in prevention of misalignment and shifting of transmission shaft 31 to form a long through hole in double gear 24 as an end plate distant from the another end plate 37 since interior teethed grooves 39 of end plate 37 is formed in the vicinity of the end of transmission shaft 31, which is away from the center point for shifting of transmission shaft 31.

The tubes 29, 33 are designed to have an interior diameter so that the tubes slip over the shaft 31 without inhibiting rotation of the shaft 31. The fit between the shaft 31 and the tubes 29, 33 is close enough so that the tubes 29, 33 stabilize the shaft 31 to minimize vibration and racking of the shaft 31. In one embodiment, the inner diameter of the tubes 29, 33 is approximately 2.2 mm and the outer diameter of the shaft 31 is approximately 2.0 mm.

Drum 35 is positioned in rectangular opening 18 formed on frame 13 such that a portion of the drum 35 is in the opening 18. The outer surface of drum 35 has a plurality of pins 34. Each pin 34 plucks a reed of vibration plate 19 which is fixed to frame 13. In other words, one end of vibration plate 19 is fixed to frame 13 while the edges of the reeds are slightly lifted in air to engage with pins 34 of drum 35. By being plucked by pins 34, vibration plate 19 plays music.

End plate 37 is press-fitted to another end of drum 37; one side of end plate 37 has tenon 38. End plate 37 and drum 35 are fixed to their positions by engaging tenon 38 with notch 36 formed on the other end of drum 35. in this configuration, drum 35 and end plates are fixed to each other with a detent, and their assembly is simple.

Each end of drum 35 has two notches 36 arranged across from each other and positioned at symmetric positions at each end. It is convenient in manufacturing for one of the notches at each end, as shown in FIG. 2, to be formed at the joint of drum 35. This pair of notches 35 at the joint is wider than the other pair of notches 36 and than tenons or projections 30, 38 with which these notches at the joint are engaged. Additionally, notch 36 is engaged to tenon 30 while the portion of notch 36 in the direction indicated with Arrow A (rotational direction) contacts the tenon; as a result, the rotational force of double gear 24 is thoroughly transmitted to drum 35.

A through hole is formed at the center of end plate 37 for receiving transmission shaft 31 as described above. In other words, transmission shaft 31 penetrates drum 35 projecting out from both of the end plates (double gear 24 and end plate 37) press-fitted to the ends of drum 35.

Locating rack 14 of frame 13 has hole 14*b* through which the hollow shaft 33 of double gear 24 extends. Also, support plate 17 having a concave portion, which receives end plate rotation support member 42, is positioned across from hole 14*b* of frame 13 on the other side of drum 35. Also, a part of transmission shaft 31 projecting from end plate 37 penetrates through end plate rotation support member 42. This configuration allows drum 35 to be rotatably held on frame 13 via end plate rotation support member 42 and supporting hollow shaft 33 of double gear 24 through the end plates, which are fastened to the ends of drum 35.

In this embodiment, the part of transmission shaft 31 projecting from end plate 37 is rotatably positioned in cylindrical end plate rotation support member 42 which contacts end plate 37 wherein cylindrical end plate rotation support member 42 is mounted in the concave portion of support plate 17 on frame 13. End plate rotation support member 42 supports rotation of end plate 37 while preventing end plate 37 from moving in the axial direction. According to this configuration, each pin 34 of drum 35 accurately engages with a corresponding reed to play precise music.

Both ends of transmission shaft 31 project from support plate 17 and hole 14*b* of frame 13 and extend outboard of frame 13. Projections 41 of transmission shaft 31 project from frame 13 and are output portions to move, for example, ornaments in the shape of animals and the like. The output from projections 41 are synchronized with music played by rotation of drum 35. This configuration, together with another output portion 27 discussed later, provides various functions. Therefore, the musical movement of the present embodiment gains product value. In turn, decoration products using this musical movement as a drive gain product value.

Additionally, teethed grooves 39 as a rotation engaging portion, similar to inner teeth, are formed in the through hole at the center of end plate 37 described above while transmission shaft 31 inserted in the through hole has a plurality of projections 40 which fit teethed grooves 39 as rotation stopping grooves corresponding to the rotation engaging portions. Accordingly, end plate 37 and transmission shaft 31 are fitted to the drum with a detent.

As described above, drum 35 is fixed in axial position. In addition, the end plate 24 hold transmission shaft 31 in axial position. Hence, transmission shaft 31 rotates completely together with drum 35.

A larger bevel gear 26 on the outer circumference of the double gear 24 engages with smaller bevel gear 28 which is fixed to the output shaft 27. Thus rotation of the double gear 24 causes the shaft 27 to rotate in a plane which is perpendicular to the plane of rotation of the drum 35. Thus, the axis of the shaft 27 and the axis of the drum 35, whether or not they actually intersect, extend in directions that are perpendicular to one another. In this fashion, the output shaft 27 is rotated in synchronization with the drum 35 since the drum 35 is affixed to the double gear 24 and rotates with the double gear 24.

Output shaft 27 is rotatably held in hole 16*a* formed on cover plate 16 described above and is positioned perpendicular to the base of frame 13. When double gear 24 and drum 35 rotate together to pay music, output shaft 27, together with the other two output portions 41 described above (both ends of transmission shaft 31), provide three outputs that are synchronized with the music.

The following describes operation of the musical movement of Embodiment 1 according to the present invention.

When crank 10 is manually rotated in a given direction, pin wheel 20 having gear portion 21 engaged with worm gear 11 rotates in the direction indicated with Arrow A. Accordingly, double gear 24 having inner teeth 25, which are engaged with hooks 23 formed on the edges of arms 22 on the outer circumference of pin wheel 20, rotates together with drum 35. Then, a plurality of pins 34 formed on the outer circumference of drum 35 pluck reeds of vibration plate 19 fixed to frame 13, hence, vibration plate 19 plays music.

Transmission shaft 31 extends through drum 35 and rotates together with drum 35. Accordingly, projections 41 as output portions on both ends of transmission shaft 31 rotate. In other words, these projections 41 rotate and output rotational movement generated by crank 10 is synchronized with music played by rotation of drum 35.

Also, when double gear 24 rotates, small bevel gear 28, which engages with large bevel gear 26 formed on the outer circumference of double gear 24, rotates in a direction perpendicular to the direction of rotation of drum 35; consequently, output shaft 27 fixed to small bevel gear 28 rotates in the direction indicated with Arrow C. In other words, this output shaft 27, similar to projections 41 rotates synchronized with music played by rotation of drum 35 while outputting force generated by rotation of crank 10.

The following describes a musical movement of Embodiment 2 according to the present invention in reference to FIGS. 6 through 10. In this embodiment, descriptions of parts identical to ones in Embodiment 1 are omitted, and such parts are described using identical symbols.

A musical movement of Embodiment 2 according to the present invention, similar to Embodiment 1, comprises: metal frame 13; vibration plate 19 which is fixed to frame 13; drum 35 and crank 10 which are rotatably held to frame 13. This musical movement of Embodiment 2 is manually driven, as is the same as Embodiment 1; however, other driving methods, such as motor driving, can be employed.

Crank 10 is held rotatably on frame 13 and is positioned perpendicular to drum 35; it is used as a driving shaft to drive drum 35. Locating rack 14, formed on frame 13, rotatably supports crank 10; it is formed of walls, including side walls and a connection piece, in a shape of a square with one side open on the base portion of frame 13. Both ends of locating rack 14 have grooves (not shown in the figures) to mount crank 10 thereon. Also, resin cover plate 61 is mounted on the top of locating rack 14 to cover the grooves.

A ratchet mechanism is placed between crank 10 and drum 35. It transmits only rotation of crank 10 in one direction to drum 35 to limit the rotation of drum 35 in one direction. When crank 10 is rotated in the reverse direction, the rotational force of crank 10 is not transmitted to drum 35. The configuration of the ratchet mechanism is almost identical to the one in Embodiment 1; therefore, detailed descriptions will be omitted, but only distinctions will be discussed hereafter.

Double gear 24 is press-fitted into one end of drum 35 as an end plate, as is in Embodiment 1; on the outer circumference of double gear 24, spur gear 62 instead of large bevel gear 26, is formed thereon. Spur gear 62 engages with crown gear 64 fixed to output shaft 63 which rotates in a direction perpendicular to the direction of rotation of drum 35; therefore, output shaft 63 is driven to rotate synchronized with rotation of drum 35 which rotates together with double gear 24.

Output shaft 63 is rotatably held in bearing portion 65 which is press-fitted in cover plate 61. In other words, cover plate 61 rotatably holds output shaft 63 while, together with frame 13, rotatably holding crank 10 as well.

Figure 8:
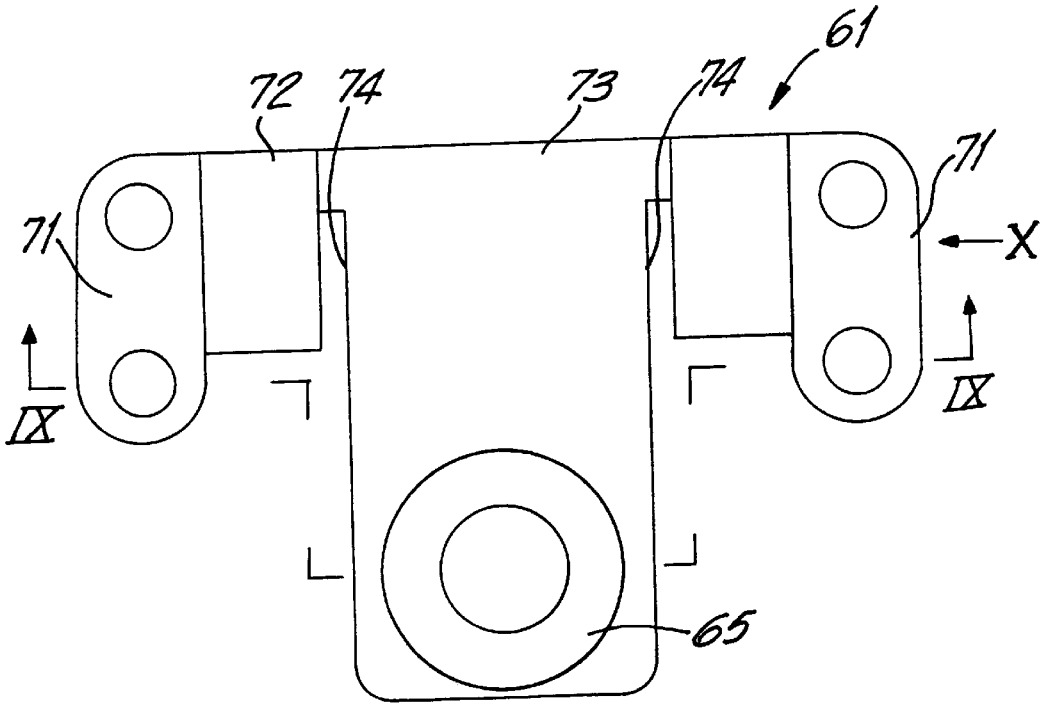
FIG. 8 is a plan view showing a cover plate of the musical movement shown in FIG. 6, viewed from the same direction as in FIG. 6.
Figure 9:
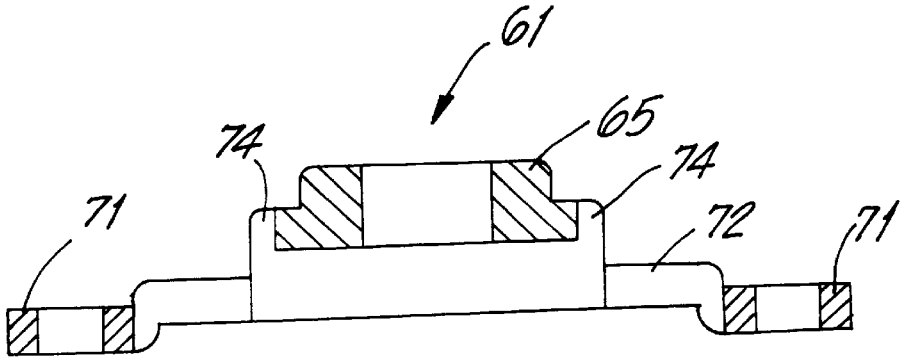
FIG. 9 is a cross section of FIG. 8 at a line between IX—IX.
Figure 10:
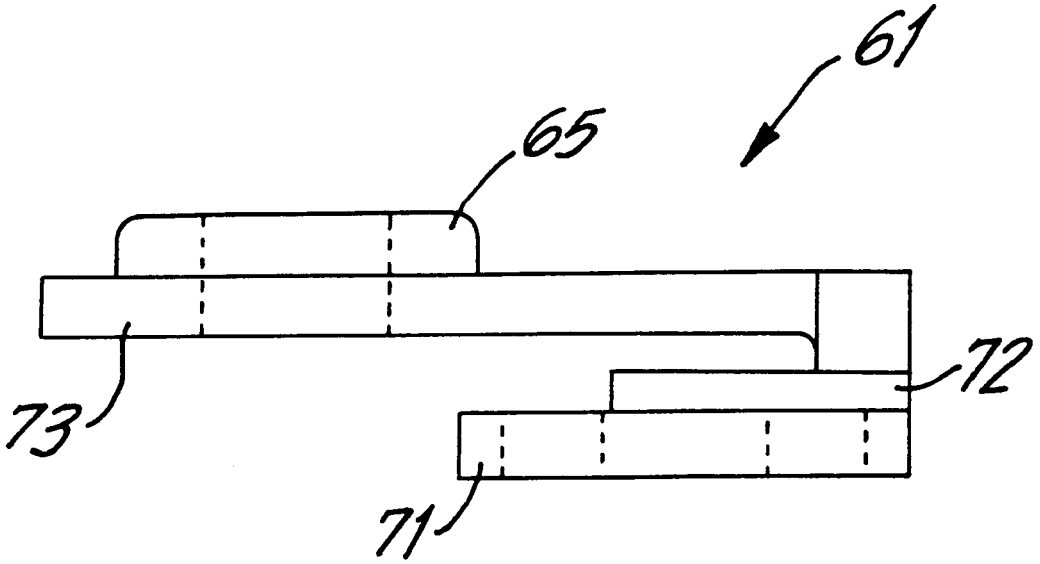
FIG. 10 is a side view of FIG. 8, viewed from the direction indicated with Arrow X.

Cover plate 61, as shown in FIGS. 8 through 10, comprises: mounting surfaces 71 which are mounted to the top of locating rack 14; cover portion 72 which continues to two mounting surfaces 71 and which covers crank 10 in locating rack 14; and output shaft support portion 73 which continues to cover 72 and which has the above bearing portion 65.

Also, two grooves 74 are formed at an area between output shaft support portion 73 and cover portion 72; they move output shaft support portion 73 supporting output shaft 63 in the vertical direction with its elasticity. In other words, one end of output shaft support portion 73 continues to cover portion 72 while maintaining its elasticity, enabling smooth engagement between spur gear 62 and crown gear 64. Also, washer 66 is attached to output shaft 63 to position output shaft 63 on bearing portion 65. Additionally, the center of double gear 24 and end plate 37 can be used for insertion of transmission shaft 31, although it is not inserted herein.

The above embodiments are some of preferable modes of the present invention. However, one is not limited to those; various modifications are applicable within a scope of the present invention. For example, only output portion is output shaft 63 in Embodiment 2; one can provide three output portions by inserting transmission shaft 31 in drum 35 as is in Embodiment 1. Also, both embodiments can be modified to have a total of four output portions by forming a gear at end plate 37 having another output shaft thereat, similar to output shafts 27, 63, or to have a total of three output portions by omitting one at double gear 24.

Additionally, transmission shaft 31 can be projected from end plate 37 by omitting projection 41 of transmission shaft 31 on end plate 37. Also, in the case of a motor-driven musical movement, instead of using crank 10, a knurling tool for mounting a gear can be formed at a part of the crank which continues straight to worm gear 11 (part indicated with W in FIGS. 6 and 7) after removing a bent portion of crank 10; furthermore, a gear itself can be mounted to the knurling tool. Additionally, when a motor is employed, the direction of rotation is constant such that a ratchet mechanism can be omitted.

In the above embodiments, a ratchet mechanism is formed in double gear 24 which also functions as an end plate of drum 35. However, it can be positioned anywhere between crank 10 and drum 35. Also, in Embodiment 1, the shape of the hooks 23 does not have to be the exact geometry shown.

In addition, output shafts 27, 63 are supported by cover plates 16, 61 in the above embodiments; however, the parts supporting output shafts 27, 63 can be different from cover plates 16, 61.

Furthermore, in Embodiment 1, two notches are formed at one end of drum 35 and two at the other end at corresponding positions wherein three of these notches 36 (two on the double gear 24 side and one on the end plate 37 side) are used to prevent double gear 24 and end plate 37 from rotating. However, those notches 36 can be completely omitted; instead, drum 35 can be press-fitted to double gear 24 and end plate 37 by press-fitting and the like to prevent rotation. Also, the number of notches 36 can be just one at each end of drum 35. These configurations including notches 36, tenons 30, 38 or hollow shafts 29, 33 of double gear 24 are applicable to an ordinary musical movement without a driving shaft such as crank 10.

As described above, according to the musical movement of the present invention, a transmission shaft is placed in a drum to penetrate therein and to project from both ends wherein the projected ends of the transmission shaft are used as output portions. Also, an output shaft as another output portion is formed such that it rotates in a direction perpendicular to the direction of rotation of the drum which is rotated by rotation of a double gear as an end plate of the drum. the output is outputted from these three output portions synchronized with music played by reeds with rotation of a driving shaft in one direction. Therefore, by using the output portions formed in various directions, a musical movement can have various functions, which is visually more attractive and interesting, by using the output portions formed in the various directions. Also, according to the above configuration, two of the three output portions are arranged close to each other; therefore, one ornament can be complexly operated by the two output portions.

Additionally, a cover plate, which protects the driving shaft, and a bearing portion, which rotatably supports the output shafts, are integrally formed of resin; this results in reduction of the number of parts. Also, the effect of force from outside applied to the output shafts can be reduced as well; as a result, one can provide a musical movement which is produced at low cost and which is highly safe.

Moreover, the musical movement of the present invention has a configuration having a ratchet mechanism, which limits the direction of rotation of the drum, between the drum and the driving shaft wherein the ratchet mechanism comprises an inner tooth gear having inner teeth, a pin wheel having arms which extend from the outer circumference across from the inner teeth in the circumferential direction. Hence, the members of the ratchet mechanism are stronger than conventional members. For example, in case of a configuration having output portions in various directions, the output portions can bear load applied thereto. As a result, the musical movement is enabled to comprise multiple outputs by the ratchet mechanism such that it can provide movements which are visually attractive and interesting.

Furthermore, according to the musical movements of the present invention, an end plate having a gear, which transmits force from the outside to the drum, is fitted to one end of the drum wherein the transmission shaft is inserted in the end plate to be fixed thereat. Therefore, the transmission shaft passing through the drum can be used as an output shaft. As a result, an ornament in a shape of animals and the like, for example, can be operated by the output shaft such that the musical movement can have a higher product value being visually attractive and interesting.

In addition, according to the musical movement of the present invention, notches are formed at both ends of the drum having pins on its outer circumference while the end plates fitted to both ends of the drum have projections which are engaged to the notches. Accordingly, the end plates can be easily fitted to both ends of the drum such that the operation to assemble the drum and the end plates can be prompt and precise. Also, the drum and the end plates are firmly engaged to each other to prevented from sliding by rotational movement; therefore, these parts rotate together.

What is claimed is:

1. A musical movement comprising:

a drum having a first axis and having pins for engaging reeds of a vibration plate to play a tune when said drum is rotated, first and second drive shafts having respective axes that extend in directions orthogonal to one another, a first end plate attached to said drum for rotation with said drum, drive gear means coupled to said first end plate to drive said first end plate in rotation, a second end plate attached to said drum for rotation with said drum, said second end plate having an interior first engaging means, said first drive shaft having second engaging means positioned to engage said first engaging means of said second end plate to cause said first drive shaft to rotate with said second end plate, said first and second end plates each having central openings therethrough, said first drive shaft extending through said openings of said first and second end plates to provide first and second output drives, a set of outer circumferential gear teeth on said first end plate, said second drive shaft coupled to said outer circumferential gear teeth to be driven thereby to provide a third output drive, rotational power applied by said drive gear means to said first end plate causing said drum and second end plate to rotate and drive said first drive shaft, said rotational power also causing said outer circumferential gear teeth to drive said second drive shaft.

2. The musical movement of claim 1 wherein said drum, said first drive shaft, said first end plate and said second end plate are all coaxial.

3. The musical movement of claim 1 further comprising:

first and second support tubes coaxial with said first drive shaft and attached to said first end plate and extending in first and second directions from said first end plate, said support tubes providing support for said first drive shaft.

4. The musical movement of claim 3 wherein said support tubes extend over at least 25 percent of the length of said first drive shaft.

5. The musical movement of claim 1 wherein said drive gear means comprises:

a double gear as part of said end plate, said set of outer gear teeth being part of said double gear, said double gear including a set of inner circumferential gear teeth, a pin wheel within said double gear and having drive arms in ratchet engagement with said inner teeth of said double gear, input rotational force from said drive gear means in a first rotational direction causing said pin wheel to drive said double gear, input rotational force in a second rotational direction causing said pin wheel to ratchet relative to said double gear.

6. The musical movement of claim 5 wherein said drive gear means comprises a gear mounted on said pin wheel axially outboard of said drive arms and adapted to engage with a worm gear from a manually operable input drive.

7. The musical movement of claim 5 wherein: said drive arms are resilient, said arms extending circumferentially in normal proximity to said inner teeth of said double gear, said inner teeth of said double gear providing support for said arms to prevent radially outward deflection of said arms when said double gear is being driven by said pin wheel.

8. The musical movement of claim 5 wherein: said drum has at least a first notch on a first end and at least a second notch on a second end and further comprising a first projection on said double gear in engagement with said first notch and a second projection on said second end plate in engagement with said second notch.

9. The musical movement of claim 1 having a frame which supports said drum, the vibration plate and said drive shafts, further comprising:

said frame having two U-shaped grooves formed therein to accommodate said first drive shaft, a cover plate to cover the upper ends of said two U-shaped grooves, and a bearing mounted on said frame for rotatably supporting said first drive shaft to permit rotation of said first drive shaft relative to the frame, said two U-shaped grooves, said cover plate and said bearing being formed of a plastic material.

10. A musical movement comprising:

a drum having a first axis and having pins for engaging reeds of a vibration plate to play a tune when said drum is rotated, a first drive shaft coaxial with said drum, first and second end plates attached to said drum for rotation with said drum, said first and second end plates having central openings therethrough, through which said first drive shaft extends to provide first and second output drives, means to rotationally drive said first end plate, engagement means between said second end plate and said first drive shaft to rotationally drive said first drive shaft when said second end plate rotates, first and second support tubes coaxial with said first drive shaft and attached to said first end plate extending in first and second axial directions from said first end plate, said first and second support tubes providing support for said first drive shaft.

11. The musical movement of claim 10 further comprising:

a set of gear teeth on an outer periphery of said first end plate, a second output shaft having a gear in engagement with said gear teeth on said outer periphery of said first end plate to provide rotational movement of said second drive shaft around a second axis to provide a third output drive.

12. The musical movement of claim 10 wherein said support tubes extend over at least 25 percent of the length of said first drive shaft.

13. The musical movement of claim 11 wherein said support tubes extend over at least 25 percent of the length of said first drive shaft.

14. In a musical movement having a drum with pins on its outer circumference and a vibration plate with reeds that generate sounds when plucked by said pins with rotation of said drum and a frame to secure the vibration plate and which rotatably supports the drum in its drive in shaft, the improvement comprising:

a primary drive shaft having a primary axis coaxial with said drum and a secondary drive shaft having a secondary axis extending in a direction perpendicular to said primary axis, a first end plate for said drum, input transmission means to cause said first end plate and said drum to rotate about said primary axis, an external gear on said first end plate being coupled to said secondary drive shaft to cause said secondary drive shaft to rotate when said first end plate rotates, a second end plate for said drum, said first end plate and said second end plate having a through hole central opening to accommodate said primary shaft, said second end plate being coupled to said primary shaft to cause said primary shaft to rotate when said second plate is driven by said drum and said first end plate, first and second support tubes extending first and second axial directions from said first end plate, said support tubes surrounding said primary drive shaft to provide support for said primary drive shaft.

15. The musical movement of claim 14 wherein said support tubes extend over at least 25 percent of the length of said primary drive shaft.

16. The musical movement of claim 14 wherein the radial clearance between said primary drive shaft and said support tubes is between 1 and 3 mm.

17. A musical movement comprising:

a drum having a first axis and having pins for engaging reeds of a vibration plate to play a tune when the drum is rotated, first and second end plates attached to said drum for rotation with said drum, said first and second end plates having central openings therethrough, a first drive shaft coaxial with said drum and extending through said central openings of said first and second end plates, a second drive shaft having a second axis extending in a direction that is substantially perpendicular to the direction of said first axis, said first end plate coupled to rotationally drive said second drive shaft, said second end plate coupled to rotationally drive said first drive shaft, first and second support tubes coaxial with said first drive shaft and attached to said first end plate and extending in first and second directions from said first end plate, said support tubes providing support for said first drive shaft, drive means coupled to said first end plate for rotationally driving said first end plate, input power from said drive means simultaneously causing said first end plate to rotate thereby (a) causing said second shaft to rotate, and (b) causing said first end plate to rotationally drive said drum which rotationally drives said second end plate which rotationally drives said first shaft, whereby said first and second drives shafts rotate in synchronism with said drum.

* * * * *